United States Patent [19]

Philippi

[11] 4,213,614

[45] Jul. 22, 1980

[54] PRACTICE WEIGHT ATTACHMENT FOR GOLF CLUBS AND METHOD OF WEIGHTING SAME

[76] Inventor: George J. Philippi, 1209 Stillman Ave., Plainfield, N.J. 07060

[21] Appl. No.: 18,857

[22] Filed: Mar. 8, 1979

[51] Int. Cl.[2] ..... A63B 69/36

[52] U.S. Cl. ..... 273/194 B; 150/52 G

[58] Field of Search ..... 150/52 G; 273/194 B, 273/194 R, 194 A, 171, 193 R, 193 A, 35 R, 186 A, 32 R

[56] References Cited

U.S. PATENT DOCUMENTS

| | | | |
|---|---|---|---|
| 2,116,655 | 5/1938 | Berrittella | 273/194 B |
| 2,526,985 | 10/1950 | Whitehead | 150/52 G |
| 2,608,409 | 5/1952 | Pinkerton | 273/194 B |
| 2,620,186 | 12/1952 | Beeaff | 273/194 A |
| 2,676,803 | 4/1954 | Damaske | 150/52 G X |
| 2,737,394 | 3/1956 | Abel | 273/194 B |
| 2,950,115 | 8/1960 | Hurdzan | 273/194 R |
| 3,133,735 | 5/1964 | Greenshields | 273/194 B |
| 3,145,749 | 8/1964 | Rosenow | 150/52 G |
| 3,398,961 | 8/1968 | Higdon | 273/194 B |
| 3,458,203 | 7/1969 | Mangis | 273/194 B |
| 3,647,220 | 3/1972 | Burkart | 273/194 A |
| 3,680,870 | 8/1972 | Burnett et al. | 273/194 B |
| 3,722,890 | 3/1973 | Weiboldt | 273/194 B |
| 3,740,053 | 6/1973 | Eiger | 273/194 B |
| 3,758,117 | 9/1973 | Harrison | 273/194 B |
| 3,820,795 | 6/1974 | Taylor | 273/194 B |
| 3,912,277 | 10/1975 | Pelz | 273/194 B |

*Primary Examiner*—George J. Marlo
*Attorney, Agent, or Firm*—Martha G. Pugh

[57] ABSTRACT

Combination weight attachment and golf club head cover for increasing the weight of the club head during practice strokes, thereby adjusting the added weight to suit the physical capability of the user. The cover consists of an upper compartment comprising a bag with a zipper closure designed to rest on the upper surface of the club head, and an open lower compartment which snugly accommodates the club head. The upper end of the cover depends from a semiannular collar including an opening constructed for slip-on engagement with the shank of the club just above the head, for holding the cover in place during the swing. Lead pellets or other weighted materials are enclosed in the zippered bag to provide means for adjusting the attached weight to individual taste.

14 Claims, 5 Drawing Figures

PRACTICE WEIGHT ATTACHMENT FOR GOLF CLUBS AND METHOD OF WEIGHTING SAME

BACKGROUND OF THE INVENTION

This invention relates in general to weighted attachments for golf clubs to facilitate practice, and more particularly, to attachments for wooden-headed clubs, such as the driver.

It is well known in the prior art to attach a rigid weight to the shank or head of a golf club to facilitate practice in swinging the club. Many of these prior art weights are not easily attached or removed. Others are attached in a manner which would scratch or otherwise damage the club head. Still others are held in position with spring clips or elastic material in a manner which might come loose during use and present a hazard. Others are forced against the club head or shank under great centrifugal force, making them ultimately difficult to remove without a hammer or other special tool. Furthermore, many of the prior art devices comprise weights which are nonadjustable.

SHORT DESCRIPTION OF THE INVENTION

Accordingly, it is the principal object of the present invention to provide an improved practice weight attachment for golf clubs which can also serve as a club head protective cover thereby making it available at all times, especially on the first tee or even during an actual golf round if desired; thus allocating special times for practice sessions is unnecessary.

A more particular object is to provide a golf club attachment with means for adjusting the added weight. Most high handicap players do not swing rhythmically but rather hit at the ball very much in the manner of someone swinging an axe to chop a tree down with no thought being given to following through after impact with the ball. In the absence of follow-through, the ball literally bounces off the club head face rather than being driven, thus sacrificing both direction and distance. If the added weight is to aid the user to acquire and maintain a rhythmic swing and follow-through, it follows that he should feel comfortable with the added weight, and should therefore be able to adjust the amount of weight to suit his particular capability.

Another object is to provide a golf club attachment which is inherently safe, which cannot fly off under the substantial centrifugal force created when the club is swung.

Another object is to provide a weight attachment which can be conveniently and quickly applied and removed on the golf course.

Another object is to provide a weight attachment for golf clubs which will not damage the head, but will actually serve as a protective covering.

These and other objects, features and advantages are realized in the golf club attachment of the present invention which takes the form of a flexible cover having two compartments, a zipper-closed bag in which weighted chips or pellets are stored, which rests on the upper surface of the club head, and a lower, partly open compartment which is designed to accommodate the club head. The cover is attached to a collar that has a tapered bore, the bore being substantially the same as the taper of the club head shank. This collar has a longitudinal, tapered slot or opening, the taper also being substantially the same as the club head shank, but slightly smaller diametrically than the bore of the collar. Thus this collar can be slipped onto the upper, or thinner section of the club shank and then dropped down where it fixedly engages the lower or thicker section of the club shank. In this fixed position, this collar engages at least 240 or 250 degrees of the club head shank's circumference and therefore cannot be dislodged. The centrifugal force created when the club is swung tends to make this collar grip the club shank tighter rather than tending to dislodge it. The cover, being attached to this collar, is also, therefore, positively held in place.

Inasmuch as the attachment of the present invention doubles as a golf club protective cover, it is available with the club at all times, especially on the first tee, even during a golf round if desired; and for this reason, it is not necessary to allot special times for practice sessions. Moreover, the attachment of the present invention is not intended as a muscle builder, but rather as a means for acquiring and maintaining a rhythmic swing and follow-through; hence, means is provided for adjusting the added weight to suit the capability and comfort of the individual user. The weight is adjusted, as desired, by adding or subtracting weights, pellets or sand from the zippered compartment.

These and other objects, features and advantages can be better understood from the detailed specification hereinafter with reference to the attached drawings.

SHORT DESCRIPTION OF THE DRAWINGS

DETAILED DESCRIPTION OF THE INVENTION

Figure 1:
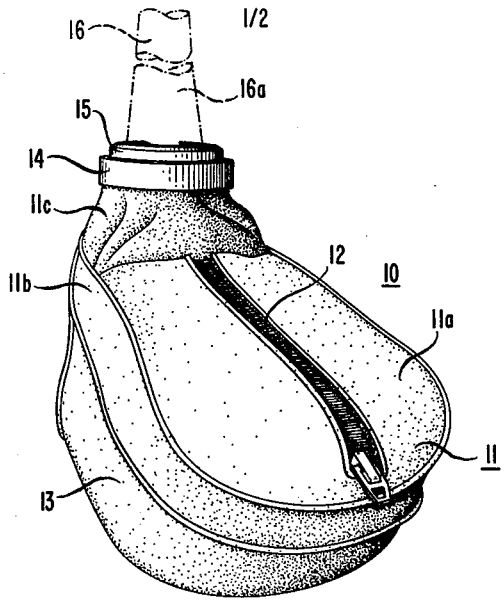
FIG. 1 is a perspective showing, viewed from the front left, of the practice weight attachment for golf clubs, of the present invention.

Referring to FIG. 1 of the drawings, the practice weight attachment 10 of the present invention is seen to have an appearance similar to that of a conventional cover used on wooden drivers and other wooden-headed golf clubs. It comprises two compartments, an upper bag or pocket 11 closed by a conventional zipper 12, which contains the weighted metal pellets 20, and a lower pocket 13 having a rearwardly-extending opening **13*a* for accommodating the golf club head 17. (See FIGS. 2 and 3**)

In the present illustrative embodiment, the upper bag or pocket 11 is, say 3½ inches (8.8 centimeters) in overall width and 4⅜ inches (11 centimeters) long, being slightly rounded at its outer end to conform to the shape of the wooden driver head. It may be formed, for example, of any well-known flexible material, such as leather, imitation-leather, plastic, such as polyvinyl chloride or polyvinyl acetate, or of heavy fabric. The horizontally-disposed top sheet 11*a* is substantially flat except for a conventional zipper opening 12, which runs down the center, away from the club shank 16. The side, or lateral wall 11*b* of the bag or pocket 11 may take the form of a strip of the same or similar material described above, about 1⅜ inches (3½ centimeters) wide at the center, which is seamed or bonded around its upper edge to the edge of sheet 11*a*. The lower edge of the lateral wall 11*b* is seamed or bonded about half way around at its forward end to the bottom piece 11*c*, which forms a pocket with a slightly rounded contour having an open end which is directed rearwardly. Pocket 13 may also be of material similar to the part 11*a* and 11*b*, or alternatively, it may be of different material. 11*c* forms the bottom wall of the pocket 11 and the upper wall of the pocket 13, and may be of the same or different material than that described with reference to 11*a*, 11*b* and 11*c*; but in any case, some type of flexible fabric strong enough to support the weighted material interposed into the pocket 11. In the present illustrative embodiment, the seams and edges have decorative binding or cording to improve the appearance and prevent fraying; but such cording is not necessary to the function of the practice weight attachment.

Figure 2:
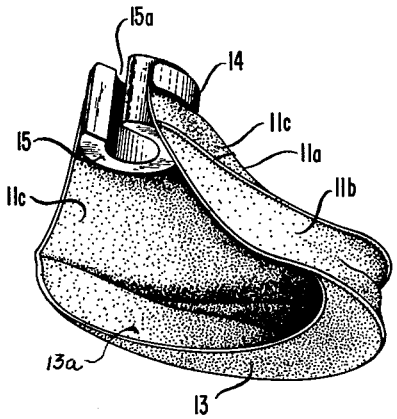
FIG. 2 is a perspective showing from the rear of the practice weight attachment of FIG. 1.
Figure 5:
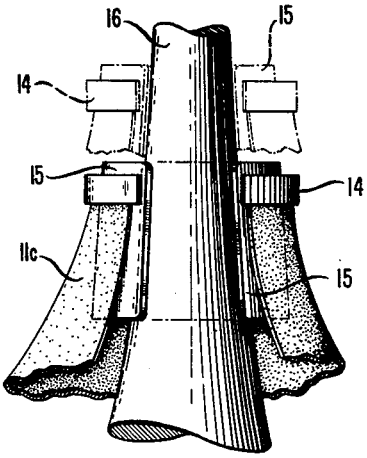
FIG. 5 is a side elevational showing the slip-on collar of FIG. 4 in mounted and removal positions on the shank of the driver golf club.
Figure 4:
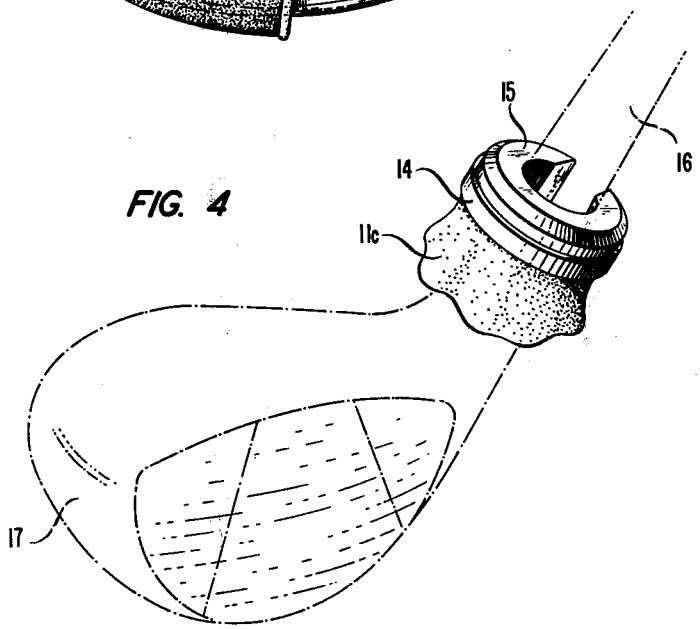
FIG. 4 is a perspective showing looking down on the slip-on collar of the practice weight attachment of the present invention.

It will be seen from FIGS. 2,4 and 5 of the drawings, that the upper end of the sheet 11*c* is permanently clamped in place by a semiannular compression ring 14 against the outer cylindrical surface of the cylindrical collar 15, the latter being preferably formed of a lightweight, rigid plastic such as tetrafluoroethylene (TEFLON) or other rigid lightweight material such as aluminum. In the present embodiment, the collar 15 is cylindrical in shape, approximately 1⅜ inches (3½ centimeters) in diameter, ⅞ inches (2.4 centimeters) long, having a longitudinally tapered slot and tapered bore. The width of the slot 15*a* should approximate the width of shank 16 above the tapered neck 16*a* so that it readily slips onto the latter. The inner bore of the collar 15 should be tapered in a manner similar to the taper of the neck 16*a*, so that when it is forced down it fits snugly onto the neck 16*a*, as shown in FIG. 5. Thus, when it is wished to apply the practice weight attachment to a given golf club driver, the collar 15 is slipped into place on the narrowest part of the shank 16, and forced down to secure it in place. To remove the attachment, collar 15 is forced upward, as shown in phantom in FIG. 5. To insure easy removal, the weight of the collar 15 should be kept to a minimum since the centrifugal force created when the club is swung increases with increased weight. Excessive weight could increase this centrifugal force to a point where the collar 15 would be driven onto the club shank 16 with sufficient force to make it difficult to remove while also damaging the club head as with some of the prior art weight attachments. As previously pointed out, in the present illustrative embodiment, the collar 15 may be of tetrafluoroethylene (TEFLON) which has a density within the range of about from 131 to 143 pounds per cubic foot. Alternatively, aluminum or its alloys, which have densities ranging from about 160 to about 172 pounds per cubic foot can also be used for this purpose. In fact, any material could be used which has a density not exceeding about 175 pounds per cubic foot.

It will be apparent that the structural details of the cover 10 may be substantially varied from those shown in the drawings, or described by way of illustration. For example, although 11*c* is shown to be attached to collar 15 by a metal compression ring 14, it is contemplated that other well-known means of bonding the two together can be substituted, such as the use of latex-based adhesive, epoxy, or the like.

Figure 3:
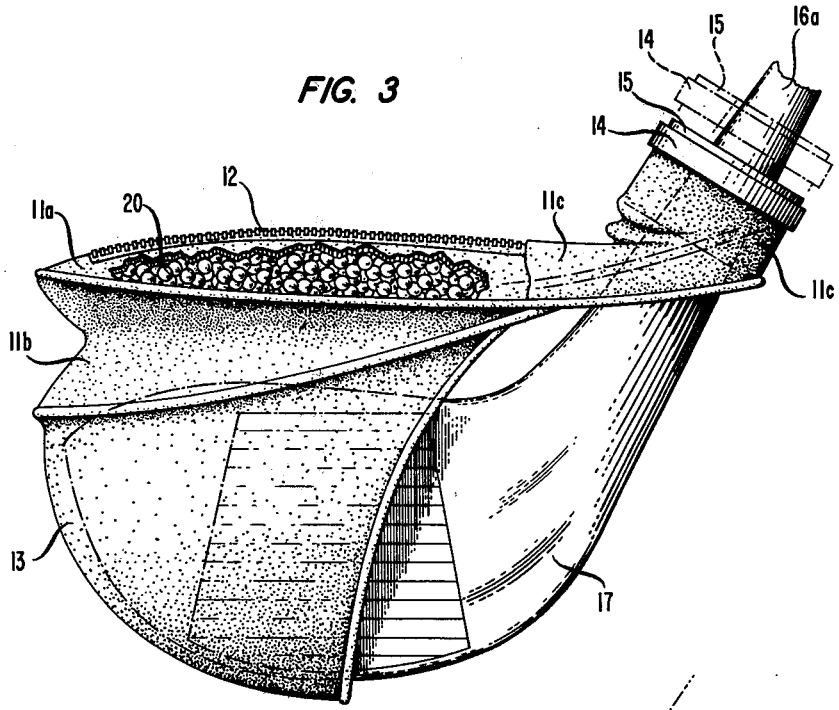
FIG. 3 is an enlarged side elevation of the practice weight attachment of FIGS. 1 and 2, mounted on the head of the driver golf club, with the top cover of the attachment broken away to show metal pellets in the interior and with the slip-on collar shown in the release position in phantom.

Referring to FIG. 3, which shows the pocket 11 filled with weighted pellets of lead, or the like, it is apparent that the weight of the device can be adjusted to individual taste by adding or subtracting pellets. In order to more securely hold the pellets in position, cotton batting, or other fiberous material, can be intermingled with the pellets in pocket 11. It will be seen that instead of metal pellets, one can use other heavy materials, such as sand or small stones, or even chips or slabs of metal, or single pieces of metal, heavier or lighter ones being substituted, as desired.

The device of the present invention is seen to have a number of advantages over golf club weight attachment of the prior art, in that it is simple to fabricate and to use. It is easy to slip into place and to remove. It does not present any safety hazard, in that the centrifugal force resulting from the golf club swing would be exerted in a direction to hold the attachment in place, and not to dislodge it. The weight to be added is readily adjustable, merely by adding or subtracting pellets to the bag 11. Further, the weight attachment serves a double purpose of acting as a cover to protect the club head during non-use.

Although the present invention has been described with reference to a specific embodiment, it will be understood that the invention is not limited to the details of the embodiment shown by way of illustration, but only by the scope of the appended claims.

What is claimed is:

1. A practice weight attachment for golf clubs having a wooden driving head supported on a shaft affixed to said head by a neck tapered from a thinner section adjacent the upper portion of said shaft to a thicker section adjacent said head, said attachment comprising in combination:

a collar having a tapered central axial bore substantially the same dimension as the thicker section of said tapered neck adjacent said wooden head, said central bore having a tapered longitudinal slot. having substantially the same taper but slightly smaller in width than said central axial bore, whereby said collar is constructed to be slipped onto said thinner section of said tapered neck and to slip down to engage substantially more than half of the circumference of said neck in the thicker section thereof, whereby said collar is held in positive engagement with said neck until removed by sliding said collar up the tapered neck adjacent said head to a point where said neck is smaller than the width of said tapered slot where it can be readily removed;

a cover of flexible fabric for said wooden driving head;

means for holding said cover fixed to and depending at one of its ends from said collar;

said cover horizontally compartmented by a partition substantially parallel to its major plane forming an upper pocket for accommodating weighted material, including means for opening said upper pocket to receive said weighted material and means for completely closing said upper pocket to enclose said weighted material; and a lower pocket secured to the underside of said upper pocket, said lower pocket having a rearwardly directed opening constructed and arranged to accommodate a wooden golf club head.

2. The combination in accordance with claim 1 which includes weighted material disposed in said upper pocket.

3. The combination in accordance with claim 1 wherein said weighted material includes one or more pieces of metal.

4. The combination in accordance with claim 3 wherein said weighted material includes metal pellets.

5. The combination in accordance with claim 3 wherein said weighted material includes sand.

6. The combination in accordance with claim 1 wherein said collar consists essentially of a rigid plastic material having a density not exceeding about 175 pounds per cubic foot.

7. The combination in accordance with claim 6 wherein said collar consists essentially of aluminum.

8. The combination in accordance with claim 6 wherein said collar consists essentially of tetrafluoroethylene.

9. The combination in accordance with claim 1 wherein said means for holding said cover fixed to and depending from said collar comprises a metal compression clamp.

10. The combination in accordance with claim 1 wherein said flexible fabric consists primarily of a material selected from the group consisting of woven fibers, leather, plastic, natural or artificial rubber.

11. The combination in accordance with claim 1 wherein said means for holding said cover fixed to and depending at one of its ends from said collar comprises a metal compression ring.

12. The combination in accordance with claim 1 wherein said means for holding said cover fixed to and depending at one of its ends from said collar comprises an adhesive.

13. The method of applying added weight for practice strokes to a golf club comprising a wooden driving head which is affixed to a shaft by a neck of tapered diameter, which method comprises the steps of:

horizontally compartmenting a golf club cover into a first closable upper compartment and a second partly open lower pocket, enclosing a preselected amount of weighted material in said first pocket and securely closing the same, slipping said second partly open pocket snugly onto said wooden golf club head so that said first pocket including said weighted material rests onto the upper surface of said wooden golf club head during a practice stroke of said golf club, securing the upper end of said golf club cover to a collar having a tapered bore slotted to accommodate said shaft, said collar being slipped onto said shaft above said tapered neck and forced down into secure relation with said neck for holding said weighted material securely on the surface of said golf head during said practice strokes.

14. The method in accordance with claim 13 wherein said weighted material is in the form of one or more metal pieces, and wherein the method of adjusting the weight for said practice strokes is by adding or subtracting metal pieces.

* * * * *